US005235387A

United States Patent [19]

Sato et al.

[11] Patent Number: 5,235,387

[45] Date of Patent: Aug. 10, 1993

[54] DEVELOPING APPARATUS USING A ONE-COMPONENT NONMAGNETIC TONER

[75] Inventors: Shuitsu Sato, Kawasaki; Mitsunaga Saito, Tokyo; Hiroki Takano, Funabashi; Masahiro Hosoya, Okegawa; Yukihiro Osugi, Shizuoka, all of Japan

[73] Assignees: Kabushiki Kaisha Toshiba, Kanagawa; Tokyo Electric Co., Ltd., Tokyo, both of Japan

[21] Appl. No.: 886,351

[22] Filed: May 21, 1992

[30] Foreign Application Priority Data

May 24, 1991 [JP] Japan ..... 3-120028

[51] Int. Cl.[5] ..... G03G 15/06

[52] U.S. Cl. ..... 355/245; 355/259; 118/653; 118/661

[58] Field of Search ..... 355/245, 259; 118/653, 118/661

[56] References Cited

U.S. PATENT DOCUMENTS

| | | | |
|---|---|---|---|
| 3,731,146 | 12/1970 | Bettiga et al. | 317/3 |
| 4,100,884 | 7/1978 | Mochizuki et al. | 118/653 |
| 4,336,318 | 6/1982 | Fukumoto et al. | 430/120 |
| 4,522,907 | 6/1985 | Mitsuhashi et al. | 430/102 |
| 4,760,422 | 7/1988 | Seimiya et al. | 355/259 |
| 4,833,058 | 5/1989 | Hirano et al. | 430/120 |
| 4,841,331 | 6/1989 | Nakayama et al. | 355/245 |
| 4,847,653 | 7/1989 | Doi et al. | 355/245 |
| 4,930,438 | 6/1990 | Demizu et al. | 118/651 |
| 4,967,231 | 10/1990 | Hosoya et al. | 355/219 |
| 5,008,708 | 4/1991 | Enoguchi et al. | 355/259 |
| 5,051,332 | 9/1991 | Hosoya et al. | 430/122 |
| 5,060,021 | 10/1991 | Yamamoto et al. | 355/245 |
| 5,066,982 | 11/1991 | Hosoya et al. | 355/269 |
| 5,110,705 | 5/1992 | Hosoya et al. | 430/120 |

*Primary Examiner*—Benjamin R. Fuller
*Assistant Examiner*—Randy W. Gibson
*Attorney, Agent, or Firm*—Finnegan, Henderson, Farabow, Garrett & Dunner

[57] ABSTRACT

On the surface of a developing roller disposed closely to a photosensitive drum, a toner supplied from a toner container to the surface is spread into a thin layer by a toner distribution and charging blade. The triboelectric charge, $q_1$, of the toner and the triboelectric charge, $q_2$, of the surface of the toner distribution and charging blade are equalized in polarity and made to satisfy a relation, $|q_2|<|q_1|$. The triboelectric charge, $q_3$, of the surface of the developing roller is made to satisfy a relation, $-4.0 \leqq q_1/q_3 \leqq -1.2$. The triboelectric charge of the toner, $q_1$, and the triboelectric charge, $q_4$, of the surface of a recovery blade for recovering the residue of toner adhering to the developing roller are equalized in polarity and, at the same time, made to satisfy a relation, $|q_4|<|q_1|$. The developing apparatus constructed of the component members satisfying these conditions constantly allows easy and infallible impartation of an appropriate triboelectric charge to the toner in an operation of supplying a thin layer of the toner to an electrostatic latent image carried on the sensitive drum thereby visualizing the electrostatic latent image.

18 Claims, 2 Drawing Sheets

DEVELOPING APPARATUS USING A ONE-COMPONENT NONMAGNETIC TONER

BACKGROUND OF THE INVENTION

This invention relates to a developing apparatus adapted for visualizing with a toner an electrostatic latent image formed on a photosensitive drum by the electrophotographic method.

Heretofore, as means for visualizing an electrostatic latent image formed on a photosensitive drum with a toner, a contact type developing apparatus having an essential construction as illustrated in FIG. 1, for example, has been known. With the developing apparatus of this kind, the development is accomplished by the following operation.

A toner 2 placed in a toner container 1 is supplied onto a developing roller 5 by toner supplying means which comprises a stirrer 3, a toner supplying roller 4, etc. The toner 2 supplied to the developing roller 5 is retained in the form of a thin layer on the surface of the developing roller 5 and, at the same time, vested with a fixed magnitude of electric charge by being passed through the area of a toner distribution and charging blade having the terminal part thereof disposed closely to the peripheral surface of the developing roller 5 and having the height thereof adjusted by a spring 6*a*. An electrostatic latent image formed on a sensitive drum 7 by an exposure device omitted from illustration in the diagram is developed by causing the toner deposited on the surface of the developing roller 5 to adhere to the photosensitive drum 7 by means of static electricity. In this manner, the electrostatic information recorded on the photosensitive drum 7 is visualized. The visible image is recorded on a recording paper by a transfer device 8, for example. The residue of the toner remaining on the developing roller 5 is recovered into the toner container 1 by a recovery blade 9. In the diagram, 10 stands for an electrification device and 11 for a cleaning unit.

The toner distribution and charging blade mentioned above is generally formed of a rubber from among urethane rubber, silicone rubber, chloroprene rubber, butadiene rubber, isoprene rubber, acrylonitrile-butadiene rubber, ethylene-propylene rubber, and natural rubbers, a varying metal from among iron, copper, aluminum, stainless steel, and alloys thereof, and a varying resin from among phenol resin, hard vinyl chloride resin, polycarbonate resin, polyacetal resin, fluorine resin, and nitro-cellulose resin. The recovery blade 9 is produced by molding polyester, Teflon (tetrafluoroethylene resin), hard vinyl chloride, coated glass cloth, or acetate in the form of a tape or sheet and optionally coating the surface of the tape or sheet with a coating material.

The developing roller 5 mentioned above is generally constructed, as illustrated in FIG. 2, by superposing on a metallic roller substrate 5*a* an elastomer layer 5*b* of oilproof rubber and superposing on the elastomer layer 5*b* an electroconductive layer 5*c*. This electroconductive layer 5*c* is generally formed by coating the elastomer layer 5*b* with an electroconductive coating material having an electroconductive filler dispersed in a commercially available solvent-soluble binder such as an electroconductive urethane type coating material or an electroconductive acrylic type coating material. It has a resistivity approximately below $10^{10}\Omega\cdot$cm.

Incidentally, in the developing apparatus constructed as described above, it has been heretofore held that for the purpose of conferring a suitable electric charge on the toner, the triboelectric charge imparting members, such as the developing roller, the toner distribution and charging blade, the recovery blade, the toner supplying roller, and the toner container against which the toner particles produce friction are desired to be opposite in charging characteristics to the toner. The electrostatic charging property of the electroconductive layer (applied layer of an electroconductive coating material) of the developing roller, for example, is found by measurement in most cases to be equal in polarity to the toner or, if opposite in polarity, to be substantially destitute of a charging ability. The electroconductive layer, therefore, is incapable of conferring a proper triboelectric charge on the toner and is consequently liable to entail the disadvantage of inferior formation of the toner layer resulting in missing portions from a developed image or uneven thickness of the toner layer or inferior conveyance of the toner. Thus, the failure of the electroconductive layer to form a practically satisfactory image has been frequently encountered.

The impartation to the toner distribution and charging blade or the recovery blade of the same degree of triboelectric charge as to the developing roller results in the following disadvantage. First, the toner tends to adhere to the toner distribution and charging blade or the recovery blade and the amount of the toner to be carried or transported by the developing roller decreases. Then, the portion of the toner which escapes being transferred to the photosensitive drum and survives consumption in image development defies recovery from the developing roller and the recovery blade into the toner container, with the result that a surplus of the toner spills down the toner container. The impartation to the toner distribution and charging blade or the recovery blade of the same degree of triboelectric charge as to the toner results frequently in the failure of the toner to produce a practically sufficient image because the triboelectric charge is improper for the toner and liable to impede satisfactory formation of a toner layer or satisfactory transfer of the toner.

The following references have disclosure regarding the material of the toner distribution and charging blade and the relation between the toner distribution and charging blade and the triboelectric charge of the toner.

U.S. Pat. No. 3,731,146 issued May 1, 1973 to A. C. Betting et al. discloses a doctor blade made of a material remote from the toner in the triboelectric series and close to the development roller surface material in the triboelectric series. This reference, however, has no disclosure about the fact that the triboelectric charge of the toner and the triboelectric charge of the developing roller surface are opposite in characteristic.

U.S. Pat. No. 4,336,318 issued Jun. 22, 1982 to H. Hukumoto et al. discloses that the triboelectric charge of the toner q (c/g) and the thickness of the toner particle layer d (mm) are adjusted to satisfy the following formula in a method for developing electrostatic images: $3\times10-8<|q\times d|>5\times10^{-6}$.

This references has no disclosure regarding the interrelation among the triboelectric charge of the toner, the triboelectric charge of the toner distribution and charging blade surface, the triboelectric charge of the developing roller surface, and the triboelectric charge of the recovery blade surface.

U.S. Pat. No. 4,883,058 issued May 23, 1989 to Y. Hirano et al. discloses a blade composed of a silicone rubber comprising 100 parts by weight of a siloxane polymer having a cross linking density of 4 to $8\times10^{-4}$ mol/cc and 30 to 70 parts by weight of silica. This references, similarly to that of U.S. Pat. No. 4,336,318, fails to disclose anything about the interrelation among the triboelectric charge of the toner, the triboelectric charge of the toner distribution and charging blade surface, the triboelectric charge of the developing roller surface, and the triboelectric charge of the recovery plate surface.

SUMMARY OF THE INVENTION

An object of this invention is to provide a developing apparatus which is capable of stably producing practically satisfactory images.

Another object of this invention is to provide a developing apparatus which is enabled to impart appropriate triboelectric charge easily, constantly, and infallibly on the toner particles being carried and transported on the developing roller by fully controlling the charging characteristics of the triboelectric charge imparting members, such as the developing roller, the toner distribution and charging blade, and the recovery blade against which the toner particles generate friction.

Still another object of this invention is to provide a developing apparatus which enables the toner to be thoroughly recovered without fail.

A further object of this invention is to provide a developing apparatus which is capable of elongating the service life thereof.

The developing apparatus of the first aspect of this invention comprises a developing roller, toner supplying means for supplying a toner to the peripheral surface of the developing roller, a toner distribution and charging blade for spreading the toner supplied to the peripheral surface of the developing roller into a thin layer, means for causing toner particles in the thin layer of toner formed on the peripheral surface of the developing roller to adhere electrostatically to an electrostatic latent image carried on a photosensitive drum, and means for developing the toner particles adhering to the photosensitive drum into a visible image, which developing apparatus is characterized by satisfying the condition that $q_1$ and $q_2$ are equal in polarity and hold the relation, $|q_2| < |q_1|$, wherein $q_1$ stands for the triboelectric charge of the toner and $q_2$ for the triboelectric charge of the surface of said toner distribution and charging blade.

The developing apparatus of the second aspect of this invention comprises a developing roller, toner supplying means for supplying a toner to the peripheral surface of the developing roller, a toner distribution and charging blade for spreading the toner supplied to the peripheral surface of the developing roller into a thin layer, means for causing toner particles in the thin layer of toner formed on the peripheral surface of the developing roller to adhere electrostatically to an electrostatic latent image carried on a sensitive drum, and means for developing the toner particles adhering to the photosensitive drum into a visible image, which developing apparatus is characterized by satisfying the condition that $q_1$ and $q_3$ hold the relation, $-4.0 \leqq q_1/q_3 \leqq -1.2$, wherein $q_1$ stands for the triboelectric charge of the toner and $q_3$ for the triboelectric charge of the developing roller surface.

The developing apparatus of the third aspect of this invention comprises a developing roller, toner supplying means for supplying a toner to the peripheral surface of the developing roller, a toner distribution and charging blade for spreading the toner supplied to the peripheral surface of the developing roller into a thin layer, means for causing toner particles in the thin layer of toner formed on the peripheral surface of the developing roller to adhere electrostatically to an electrostatic latent image carried on a sensitive drum, means for developing the toner particles adhering to the photosensitive drum into a visible image, and a recovery blade for recovering the residue of the toner adhering to the developing roller after the adhesion of the toner particles to the photosensitive drum, which developing apparatus is characterized by satisfying the condition that $q_1$ and $q_4$ hold the relation, $|q_4| < q_1|$, wherein $q_1$ stands for the triboelectric charge of the toner and $q_4$ for the triboelectric charge of the recovery blade surface.

The developing apparatus of this invention, as described above, satisfies at least one of the following conditions.

(1) The triboelectric charge, $q_1$, of the toner and the triboelectric charge, $q_2$, of the toner distribution and charging blade are equal in polarity and hold the relation, $|q_2| < |q_1|$.

(2) The triboelectric charge, $q_1$, and the triboelectric charge, $q_3$, of the developing roller hold the relation, $-4.0 \leqq |q_1/q_3 \leqq -1.2$.

(3) The triboelectric charge, $q_1$, and the triboelectric charge, $q_4$, of the recovery blade surface hold the relation, $|q_4| < |q_1|$.

The satisfaction of the condition (1) mentioned above allows prevention of the adhesion of the toner particles to the toner distribution and charging blade and the shortage in triboelectric charging of the toner. Preferably, the condition of (1) is such that the difference between $q_1$ and $q_2$ is at least 250 nC. In this case, further, if the triboelectric charge, $q_3$, of the developing roller surface differs in polarity from the aforementioned magnitudes, $q_1$ and $q_2$, the developing roller is enabled to impart appropriate triboelectric charge to the toner. As a result, the electrostatic attraction between the toner and the developing roller surface is retained in an appropriate range, the efficiency of development is enhanced, and the amount of the toner deposited on the developing roller surface per unit area is retained in an appropriate range, and the problem of excess consumption of the toner and the problem of shortage of the toner in the development are precluded. Further, the problem of spill of the toner due to excessive deposition, the problem of insufficient recovery of the toner, and the problem of spill of the toner due to inferior triboelectric charging can be also eliminated.

The satisfaction of the condition (2) mentioned above results in facilitating the impartation of appropriate triboelectric charge to the toner. If the numerical value of the quotient, $q_1/q_3$, is less than $-4.0$, the electrostatic attraction between the toner and the developing roller surface is unduly weak, the amount of the toner deposited on the developing roller surface per unit area is unduly small, and the density of the developed image is unduly low and, particularly when a wholly black image is given to be developed, the produced image shows uneven toner density in the leading terminal part and the trailing terminal part thereof. The problem of insufficient triboelectric charging of the toner and the problem of spill of the toner from the developing roller surface also ensue. Conversely, if the numerical value of the quotient, $q_1/q_3$, exceeds $-1.2$, the electrostatic attraction between the toner and the developing roller surface is unduly strong, the efficiency of development of the toner on the photosensitive drum surface is unduly low, and the amount of the toner deposited on the developing roller surface per unit area is unduly large, possibly with the result that the consumption of the toner is increased, the spill of the toner particles from the developing roller surface is suffered to occur, and the recovery of the residue of toner after the development is not sufficient. The relation of the quotient in the condition of (2) is desired to be $-2.0 \leqq q_1/q_3 \leqq -1.3$, preferably $-1.8 \leqq q_1/q_3 \leqq -1.5$. Further, the satisfaction of the condition of (3) mentioned above allows prevention of the adhesion of the toner particles to the recovery blade and the shortage of charging of the toner. The condition of (3) is desired to be such that the difference between $q_1$ and $q_4$ is at least 250 nC. In this case, the same effect as attained under the condition of (1) is accomplished by differentiating $q_3$ in polarity from $q_1$ and $q_2$.

The fulfillment of these conditions allows easy impartation of an effective electric charge to the toner, enables linear images to be produced with ample sharpness and wholly black images to be produced with sufficient uniformity infallibly, and even elongates the service life of the developing apparatus. In addition, the residue of toner which would otherwise suffered to accumulate on the surface of the developing roller can be infallibly recovered into the toner container.

The triboelectric charge, q, indicated herein with respect to a varying component member of the developing apparatus of this invention represents the magnitude determined by the use of an electrostatic coated surface analyzing device. FIG. 3 is a type illustration of the construction of one example of the electrostatic coated surface analyzing device (produced by Toshiba Chemical K.K.). The electrostatic coated surface analyzing device illustrated in FIG. 3 is operated by a procedure of fixing a metallic plate coated with a sample in place on a slanted plate 21, allowing a contact powder 22 to fall onto the metallic plate through a standard contact powder hopper 23, causing the triboelectric charge generated between the contact powder 22 rolling down the metallic plate and the metallic plate coated with the sample to be led by a meter connecting terminal 24 to an electro-meter 25 and subjected to measurement therein, and registering the outcome of the measurement as a "triboelectric charge q." In FIG. 3, 26 is a receptacle and 27 is an insulatinq plate. As respects the standard conditions of determination, the atmosphere of the site of determination is maintained at 25° C. and 55% RH, spherical iron particles 70 μm to 150 μm in diameter (a product of Powder Tech K.K. marketed under product code of "FL2030") are poured onto the metallic plate in a fixed size of 1.3 g per round over a period of five seconds and allowed to roll down a distance of 90 mm on the metallic plate, the slanted plate 21 is fixed at an angle of 60 degrees, and the measurement is made at five points per sample. The metallic plate coated with a sample is a stainless steel plate measuring 75 mm×100 mm in area. The coating is effected by the dipping method when the sample is in a liquid state. When the sample is in a solid state (in the form of sheet), it is cut into pieces of suitable size and applied to the metallic plate through the medium of an electroconductive double-face adhesive tape.

The use of the electrostatic coated surface analyzing device constructed as described above enables the charging characteristics of a given surface with respect to the toner to be found practically. In the determination of triboelectric charges imparted to the surfaces of the developing roller, the toner distribution and charging blade, the recovery blade, etc. by the use of the electrostatic coated surface analyzing device mentioned above, raw materials or coating materials for the relevant component members of the developing apparatus can be selected to satisfy the conditions of (1) to (4) mentioned above in accordance with the charging polarity and the triboelectric charge of the toner. The developing apparatus contemplated by this invention is constructed of these component members.

As a specific measure, the satisfaction of the conditions (1) to (3) mentioned above in the electroconductive layer of the developing roller is accomplished by incorporating in the electroconductive coating material or in the toner distribution and charging blade or the recovery blade by incorporating in the coating material applied to the surface of the substrate thereof a pertinent material indicated below in a proportion selected in the range of from 0.1% by weight to 100% by weight in accordance with the triboelectric charge aimed at.

For the impartation of positive charge to the developing roller, the toner distribution and charging blade, and the recovery blade, a coating material containing a charge regulating agent capable of improving the charging property in the positive direction is used. The charge regulating agents which improve the charging property in the positive direction include azine type nigrosine bases, electron donating dyes such as nigrosine derivatives, polymers such as styrene-acryl-quaternary ammonium salt copolymers, styrene-quaternary ammonium salt copolymers, acryl-quaternary ammonium salt copolymers, butadiene-acryl-quaternary ammonium salt copolymers, and butadiene-acryl-styrene-quaternary ammonium salt copolymers which contain a quaternary ammonium salt as a component unit, organic quaternary ammonium salts such as benzomethyl-hexyldecyl ammonium, silane compounds containing an amino group such as α-aminopropyltriethoxy silane, amino-modified silicone oils, organic titanium compounds containing an amino group such as isopropyl tri(n-ethylaminoethylamino)titanate, zircoaluminate type coupling agents containing an amino group, aromatic amines and aliphatic amines such as phenylene diamine, diethylene triamine, triethylene tetramine, 1,12-dodecane diamine, and 2-methylpentamethylene diamine, simple elements and compounds of tungsten and molybdenum, nitrogen-containing heterocyclic compounds such as pyridine, primary, secondary, and tertiary amines, organic pigments containing a quaterryary ammonium salt in the backbone thereof, silica treated with an amino group-containing silane compound or an amino group-containing titanate compound, and polyamide type resins such as N-methylmethoxy polyamide, for example.

For the impartation of negative charge, a coating layer containing a charge regulating agent capable of improving the charging property in the negative direction is formed on the surfaces of the developing roller, the toner distribution and charging blade, and the recovery blade. The charge regulating agents which improve the charging property in the negative direction include metal complexes of azo type dyes, electron accepting dyes such as metal complexes of alkylsalicylic acids and alkyl-naphthoic acids, fluorine compounds such as tetrafluoroethylene, chlorinated polyolefin, polyester resins of high acid values, hydro-phobic silica, and organic pigments containing a sulfonic acid group, for example.

As the substrate for the application of the coating material containing such a charge regulating agent as described above, any of the materials heretofore used as for the toner distribution and charging blade and the recovery blade can be used.

In the impartation of negative charge to the recovery blade and the toner distribution and charging blade, use of a polytetra-fluoroethylene (PTFE) resin possessing a fibrous structure can obviate the necessity for treating the surface of the substrate. PTFE is a useful material because of chemical stability. The conventional PTFE sheet has not proved easily usable because it is hard, because the charging property thereof fulfills the relations mentioned above only with difficulty, and because it permits no easy application thereto of the coating material mentioned above and, therefore, allows surface modification thereof by the application of the coating material to be attained only with great difficulty. In contrast, the PTFE which has a fibrous internal texture can be used directly as the recovery blade and the toner distribution and charging blade in this invention because it is soft, because it is readily formable especially for the recovery blade, and because the charging characteristics of the surface thereof fall in a range suitable for the impartation of a negative charging property. Moreover, the adoption of the PTFE possessing this fibrous texture for the recovery blade and the toner distribution and charging blade brings about the advantage of diminishing the deformation and the change of pressing force due to the wear during a protracted service.

In the developing apparatus of this invention, the known one-component nonmagnetic toner which is composed of a resin binder, a coloring agent, a charge regulating agent, wax, and an anticaking agent is used. As the resin binder, various resin binders such as styrene polymers and substituted styrene polymers and acryl type resins which have been heretofore used for the toners of interest are available.

The styrene polymers and substituted styrene polymers mentioned above include styrene homopolymers, hydrogenated styrene resins, styrene-isobutylene copolymer, styrenebutadiene copolymer, acrylonitrile-butadiene-styrene terpolymer, acrylonitrile-styrene-acrylic ester terpolymer, styrene-acrylonitrile copolymer, acrylonitrile-acryl rubberstyrene terpolymer, acrylonitrile-chlorinatedpolystyrene styrene terpolymer, acrylonitrile-EVA-styrene terpolymer, styrene-p-chlorostyrene copolymer, styrene-propylene copolymer, styrene-butadiene rubber, styrene-maleic ester copolymers, styrene-isobutylene copolymer, and styrene-maleic anhydride copolymer, for example. The acrylic type resins mentioned above include polyacrylates, polymethyl methacrylates, polyethyl methacrylates, poly-n-butyl methacrylates, polyglycidyl methacrylates, fluorine-containing poly-acrylates, styrene-methacrylate copolymers, styrene-butyl meth-acrylate copolymers, and styrene-ethyl acrylate copolymer, for example. In addition, polyvinyl chloride, polyvinyl acetate, polyethylene, polypropylene, polyesters, polyurethane, polyamides, epoxy resins, phenol resins, urea resins, polyvinyl butyral, poly-acrylic acid resin, rosin, modified rosin, terpene resins, aliphatic or alicyclic hydrocarbon resins, aromatic petroleum resins, chlorinated paraffins, and paraffin waxes can be used either independently or in a suitably combined form.

The coloring agents which are usable for a colored toner include such known pigments and dyes as insoluble azo pigments, azo lakes, condensed azo pigments, chelate azo pigments, phthalocyanin pigments, anthraquinone, perylene, thioindigo, quinacridone, dioxazine, iso indolinone, and quinophthalone, for example. These color toner grade coloring agents can be used in the form a combination of two or more members. For a black toner, carbon black is mainly used. Carbon black is not specifically discriminated on account of its origin. Acetylene black, furnace black, thermal black, channel black, and ketzen black can be used also independently or in the form of a mixture of two or more members. Optionally, two or more color toner grade coloring agents mentioned above may be used as suitably combined.

The charge regulating agents which are effectively usable herein include metal chelates of alkyl salicylic acids, metal chelates of alkyl naphthoic acids, metal chelates of benzylic acid, quaternary ammonium salts, chlorinated polyesters, high acid valve polyesters, chlorinated polyolefins, metal salts of fatty acids, negative polarity regulating agents such as fatty acid soaps, dimethylaminoethyl methacrylate-styrene copolymer, fluorine-activating agents, and positive polarity regulating agents such as hydrophobic silica, for example. The anti-caking agents which are effectively usable herein include hydrophobic silica, metallic soaps, fluorides, metal oxides, and minute spherical resin particles of PMMA, Teflon (tetrafluoroethylene resin), and styrene, for example.

Since the developing apparatus of this invention which comprises the component elements described above is capable of imparting effective electric charge stably to the toner, the image characteristics can be enhanced and liner images can be produced clearly and wholly black images uniformly easily at all times. The necessary functions can be retained for a long time without any sacrifice of the characteristics of the toner in spite of adverse environmental conditions. Thus, the developing apparatus of this invention promises many advantages in point of actual use. Moreover, the problem of spill of the toner from the developing apparatus can be prevented infallibly.

DETAILED DESCRIPTION OF THE PREFERRED EMBODIMENTS

Now, this invention will be described below with reference to working examples.

EXAMPLE 1

A toner distribution and charging blade having a coating layer formed on the surface thereof with an electroconductive coating material possessed of a triboelectric charge of −70 nC as determined with the aforementioned coated surface analyzing device under the aforementioned conditions was prepared. Specifically, this toner distribution and charging blade was produced by applying an electroconductive coating material (a product of Shinto Chemitron K.K. marketed under trademark designation of "Shintolon D-4256") to the surface of a toner distribution and charging blade substrate (urethane foam) by the spraying technique and drying the applied layer of the coating material in an oven for 20 minutes.

A developing roller having a coating layer formed on the surface thereof with an electroconductive coating material possessed of a triboelectric charge of 550 nC as determined with the aforementioned coated surface analyzing device under the aforementioned conditions was prepared. Specifically, the electroconductive coating material was prepared by dissolving 5 parts by weight of an acryl-quaternary ammonium salt-containing copolymer resin in 100 parts by weight of an electroconductive coating material (a product of Shinto Chemitron K.K. marketed under trademark designation of "Shintolon D4256E"). The developing roller was produced by applying an electroconductive coating material to the surface of a developing roller substrate (urethane rubber) by the dipping technique and drying the applied layer of the coating material in an oven for 20 minutes.

As the toner, a negatively charging toner comprising 92 parts by weight of a polyester resin, 4 parts by weight of carbon, 2 parts by weight of a low molecular polypropylene, 2 parts by weight of a metal-containing dye, and 0.5 part by weight of silica as an external additive and having a volume average particle diameter of 10 μm was used. By the determination with the coated surface analyzing device under the aforementioned conditions, the toner was found to have a triboelectric charge of −675 nC. For the determination of the triboelectric charge of the toner, a sample was prepared by dissolving part of the toner in toluene as a solvent and applying the resultant solution as a coating material to a metallic plate.

Figure 1:
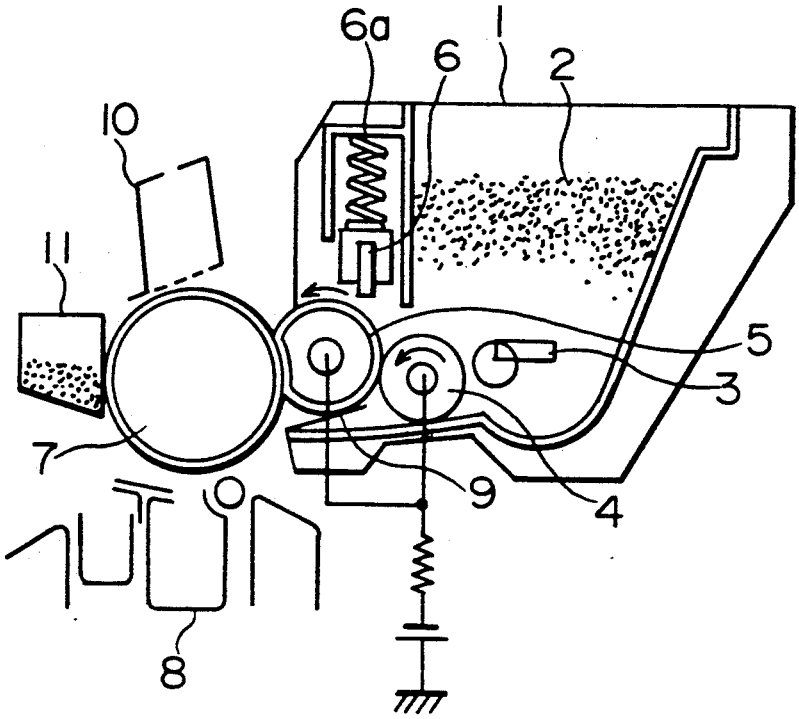
FIG. 1 (PRIOR ART)
FIG. 1 is a cross section illustrating the essential construction of a developing apparatus.
Figure 2:
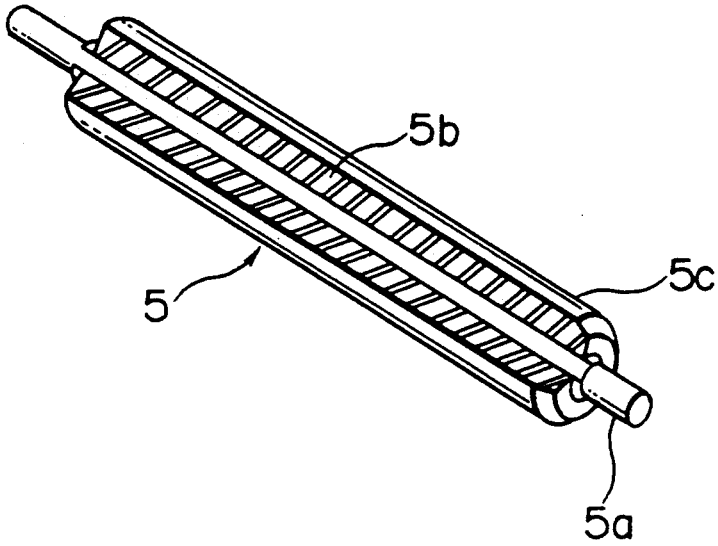
FIG. 2 (PRIOR ART)
FIG. 2 is a partially cutaway perspective view illustrating the construction of a developing roller.
Figure 3:
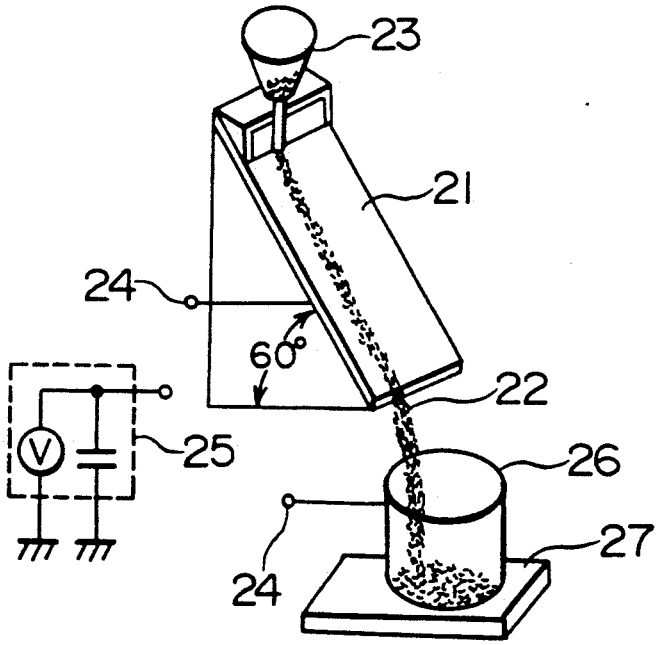
(PRIOR ART) FIG. 3
FIG. 3 is a diagram illustrating the operating principle of an electrostatic coated surface analyzing device for use in the determination of charging.

An experimental developing apparatus was obtained by setting the developing roller and the toner distribution and charging blade described above into developing apparatus the essential construction of which is illustrated in FIG. 1 and was put to service in developing images under the following conditions.

A photosensitive drum 7 was rotated at a surface speed of 50 mm/ sec, uniformly charged to a surface potential of −500 V by corona discharge from a triboelectric charger 10, subjected to the action of a laser as an exposure device for the purpose of registration of image information, then rotated at a surface speed of 100 mm/sec, and pressed against the developing roller 5 charged in advance to −200 V to effect a required inversion development. The resultant developed image of toner particles was transferred onto a recording paper by a DC corona discharge at 6 kV in a transfer device 8 and then thermally fixed thereon.

The images produced in consequence of the transfer were clearly linear images and wholly black images of high density. The images produced even after life test on 30,000 copy papers were clear images retaining the initial conditions and showing no sign of deterioration. Even under the conditions of 30° C. and 80% RH, the experimental developing apparatus produced truly ideal images.

COMPARATIVE EXPERIMENT 1

A toner distribution and charging blade having a coating layer formed on the surface thereof with an electroconductive coating material possessed of a triboelectric charge of −340 nC as determined by the use of the coated surface analyzing device under the aforementioned conditions was prepared. Specifically, the toner distribution and charging blade was produced by applying an electroconductive coating material (a product of Nippon Achison K.K. marketed under trademark designation of "Emuraron 345E") to the surface of a blank toner distribution and charging blade (urethane rubber) by the spray technique and drying the applied coating layer of the coating material in an oven at for 20 minutes.

As the toner, a negatively charging toner comprising 92 parts by weight of a polyester resin, 4 parts by weight of carbon, 2 parts by weight of a low molecular weight polypropylene, 2 parts by weight of a quaternary ammonium salt, and 0.5 part by weight of silica as an external additive and having a volume average particle diameter of 10 μm was used. By the use of the toner distribution and charging blade under the aforementioned conditions, this toner was found to have a triboelectric charge of −150 nC.

An experimental developing apparatus was produced by setting the toner distribution and charging blade into developing apparatus the essential construction of which is illustrated in FIG. 1 and was put to service in developing images under the same conditions as in Example 1. Line images obtained in consequence of the transfer were clear. Wholly black images similarly obtained showed a sign of uneven and poor conveyance of toner, with the image density found to be 1.0 by the determination with a McBeth densitometer.

EXAMPLE 2 AND COMPARATIVE EXPERIMENTS 2 TO 4

Developing rollers and toner distribution and charging blades were produced in the same manner as those of Example 1 and Comparative Experiment 1, excepting the magnitudes of triboelectric charge of the electroconductive coating materials applied to the substrates were changed (determined in the same manner as in Example 1) as shown in Table 1. Experimental developing apparatuses were obtained by setting these developing rollers and toner distribution and charging blades in place in blank developing apparatuses the essential construction of which is shown in FIG. 1 and put to service in developing images. The toners used in these experimental developing apparatuses were identical to the toner used in Example 1. The results are shown in Table 1.

TABLE 1

| | coating layer triboelectric charge (nC) | | image | | after life test on | under 30° C., |
|---|---|---|---|---|---|---|
| | developing roller | blade | line | wholly black | 30,000 papers | 80% RH |
| Example 2 | 210 | −70 | ◎ | ◎ | ◎ | ◎ |
| Comparative Experiment 2 | −70 | −70 | ∘ | x | x | x |
| Comparative Experiment 3 | −70 | 550 | ∘ | Δ | x | x |

TABLE 1-continued

| | coating layer triboelectric charge (nC) | | image | | after life test on | under 30° C., |
|---|---|---|---|---|---|---|
| | developing roller | blade | line | wholly black | 30,000 papers | 80% RH |
| Comparative Experiment 4 | 210 | 550 | ○ | Δ | Δ | Δ |

EXAMPLE 3

A developing roller having a coating layer formed on the surface thereof with an electroconductive coating material having a triboelectric charge of 400 nC as determined by the use of the aforementioned coated surface analyzing device under the aforementioned conditions was prepared. The electroconductive coating material was prepared by dissolving 10 parts by weight of an acryl-quaternary ammonium salt-containing copolymer resin in 100 parts by weight of an electroconductive coating material (a product of Shinto Chemitron K.K. marketed under trademark designation of "Shintolon D-4256E") and 100 parts by weight of an electroconductive coating material (a product of Shinto Chemitron K. K. marketed under trademark designation of "Shintolon D-4253E") and stirring the solution. The developing roller was obtained by applying the electroconductive coating material to the surface of a developing roller substrate (urethane rubber) by the dipping technique and drying the applied layer of the coating material in an oven for 20 minutes. The toner used herein was identical with that used in Example 1. Here, $q_1/q_3$, was $-1.688$.

An experimental developing apparatus was produced by setting the developing roller in place in a blank developing apparatus the essential construction of which is illustrated in FIG. 1 and was put to service in developing images. The images produced in consequence of the transfer were clear linear images and wholly black images of uniform density. Even after life test on 30,000 recording papers, the images were clear images retaining the initial conditions and showing no sign of deterioration. Even under the conditions of −30° C. and 80% RH, truly ideal images were obtained.

EXAMPLE 4

A recovery blade having a coating layer formed on the surface thereof with an electroconductive coating material having a triboelectric charge of −70 nC as determined by the use of the coated surface analyzing device under the aforementioned conditions. To be specific, the recovery blade was obtained by applying an electroconductive coating material (a product of Nippon Achison K.K. marketed under trademark designation of "Emuroran 345E") to the surface of a recovery blade substrate (polyester sheet) by the spray technique and then drying the applied layer of the coating material in an oven for 20 minutes. An experimental developing apparatus was produced by setting the recovery blade in place in a blank developing apparatus the essential construction of which is illustrated in FIG. 1 and put to service in developing images under the same conditions as in Example 1. The toner used herein was identical with that used in Example 1.

A developing roller was produced by applying an electroconductive coating material possessing a triboelectric charge of 550 nC as determined by the coated surface analyzing device under the aforementioned conditions to the surface of a developing roller substrate (urethane rubber) by the dipping technique and the drying the applied layer of the coating material in an oven for 20 minutes.

The images produced in consequence of transfer were clear linear images and wholly black images of uniform density. Even after life test on 30,000 recording papers, the images were clear retaining the initial conditions and showing no sign of deterioration. Even under the conditions of 30° C. and 80% RH, truly ideal images were produced.

COMPARATIVE EXPERIMENT 5

An experimental developing apparatus similar to the developing apparatus the essential construction of which is shown in FIG. 1 was produced using a recovery blade of a polyester sheet possessing a triboelectric charge of +170 nC as determined by the use of the coated surface analyzing device under the aforementioned conditions and evaluated under the same conditions as in Example 1. Though linear images were clear, wholly black images showed a sign of uneven and poor conveyance of the toner, with the density of 1.0 determined by the use of a McBeth densitometer.

EXAMPLE 5

A recovery blade was produced from a fibrous PTFE sheet possessing a triboelectric charge of −130 nC as determined by the use of the coated surface analyzing device under the aforementioned conditions. An experimental developing apparatus similar to the developing apparatus the essential construction of which is shown in FIG. 1 was produced by incorporating the recovery blade and evaluated under the same conditions as in Example 1. The images produced in consequence of transfer were clear linear images and wholly black images of high density. Even after life test on 30,000 recording papers, the images were clear retaining the initial conditions and showing no sign of deterioration. Even under the conditions of 30° C. and 80% RH, truly ideal images were obtained.

In the working examples described thus far, the developing apparatuses have been described mainly with respect to the developing roller having the surface thereof coated with an electroconductive coating material, the toner distribution and charging blade, and the recovery blade. As regards the toner distribution and charging blade and the recovery blade, they function safely even when the coating materials used therefor lack electroconductivity. Further, if no coating material is used, the developing apparatus functions normally to produce the operation and effect as aimed at so long as the relation of the toner with the developing roller, the toner distribution and charging blade, and the recovery blade satisfies the conditions of this invention.

What is claimed is:

1. A developing apparatus comprising;

a developing roller, toner supply means for supplying a toner to a peripheral surface of said developing roller, a toner distribution and charging blade for spreading said toner supplied to said peripheral surface of said developing roller into a thin layer, and development means for causing toner particles in said thin layer of toner formed on the peripheral surface of said developing roller to be electrostatically deposited on an electrostatic latent image carried on a photosensitive drum and developed in a visible image thereon, a frictionally produced tribroelectric charge $q_1$ of said toner, a frictionally produced tribroelectric charge $q_2$ of a surface of said toner distribution and charging blade, wherein said toner is a one-component nonmagnetic toner, $q_1$ and $q_2$ are equal in polarity, and the relation, $|q_2|<q_1|$ is satisfied.

2. A developing apparatus comprising;

a developing roller, toner supply means for supplying a toner to a peripheral surface of said developing roller, a toner distribution and charging blade for spreading said toner supplied to said peripheral surface of said developing roller into a thin layer, and development means for causing toner particles in said thin layer of toner formed on the peripheral surface of said developing roller to be electrostatically deposited on an electrostatic latent image carried on a photosensitive drum and developed in a visible image thereon, a frictionally produced tribroelectric charge $q_3$ of said toner, a frictionally produced tribroelectric charge $q_1$ of a surface of said developing roller, wherein said toner is a one-component nonmagnetic toner and the relation $-4.0 \leqq q_1/q_3 \leqq -1.2$ is satisfied.

3. A developing apparatus comprising;

a developing roller, toner supply means for supplying a toner to a peripheral surface of said developing roller, a toner distribution and charging blade for spreading said toner supplied to said peripheral surface of said developing roller into a thin layer, development means for causing toner particles in said thin layer of toner formed on the peripheral surface of said developing roller to be electrostatically deposited on an electrostatic latent image carried on a photosensitive drum and developed in a visible image thereon, and a recovery blade for recovering the residue of the toner deposited on said developing roller after said deposition of said toner on said photosensitive drum, a frictionally produced tribroelectric charge $q_1$ of aid toner, a frictionally produced tribroelectric charge $q_4$ of a surface of said recovery blade, wherein said toner is a one-component nonmagnetic toner, $q_1$ and $q_4$ are equal in polarity and the relation, $|q_4|<|q_1|$ is satisfied.

4. A developing apparatus according to claim 1, wherein said development means brings said toner into contact with said electrostatic latent image deposited on said photosensitive drum and said toner is electrostatically attached to said electrostatic latent image to develop the image.

5. A developing apparatus according to claim 2, wherein said development means brings said toner into contact with said electrostatic latent image deposited on said photosensitive drum and said toner is electrostatically attached to said electrostatic latent image to develop the visible image.

6. A developing apparatus according to claim 3, wherein said development means brings said toner into contact with said electrostatic latent image deposited on said photosensitive drum and said toner is electrostatically attached to said electrostatic latent image to develop the image.

7. A developing apparatus according to claim 1, wherein a frictionally produced tribroelectric charge of a surface of said developing roller, $q_3$, is provided that satisfies the relationship $-4.0 \leqq q_1/q_3 \leqq -1.2$.

8. A developing apparatus according to claim 3, wherein a frictionally produced tribroelectric charge of said toner distribution and charging blade, $q_2$, is provided which satisfies, $q_1$ and $q_2$ are equal in polarity and the relationship, $|q_2|<|q_1|$.

9. A developing apparatus according to claim 3, wherein a frictionally produced tribroelectric charge of a surface of said developing roller, $q_3$, is provided which satisfies the relationship, $-4.0 \leqq q_1/q_3 \leqq -1.2$.

10. A developing apparatus according to claim 3, wherein a frictionally produced tribroelectric charge of a surface of said toner distribution and charging blade, $q_2$, and a frictionally produced tribroelectric charge of a surface of said developing roller, $q_3$, is provided which satisfies $q_1$ and $q_2$ are equal in polarity and the relationship, $|q_2|<|q_1 51$, $-4.0 \leqq q_1/q_3 \leqq -1.2$.

11. A developing apparatus according to claim 1, wherein $q_1$ and $q_2$ are respectively in ranges of $-750$ nC$<q_1<-140$ nC and $-200$ nC$<q_2-50$ nC.

12. A developing apparatus according to claim 1, wherein $q_1$ and $q_2$ are respectively in ranges of $+50$ nC$<q_1<+400$ nC and $+10$ nC $<q_2 21$ $+300$ nC.

13. A developing apparatus according to claim 2, wherein $q_1$ and $q_3$ are respectively in ranges of $-750$ nC$<q_1<-140$ nC and $+300$ nC $\leqq q_3 \leqq +625$ nC.

14. A developing apparatus according to claim 2, wherein $q_1$ and $q_3$ are respectively in ranges of $+50$ nC$<q_1<+400$ nC and $-300$ nC$\leqq q_3 \leqq -50$ nC.

15. A developing apparatus according to claim 3, wherein $q_1$ and $q_4$ are respectively in the ranges of $-750$ nC$<q_1<-140$ nC and $-200$ nC$\leqq q_4 \leqq -50$ nC.

16. A developing apparatus according to claim 3, wherein $q_1$ and $q_4$ are respectively in ranges of $+50$ nC$<q_1<+400$ nC and $+10$ nC$\leqq q_4 \leqq +300$ nC.

17. A developing apparatus according to claim 10, wherein $q_1$, $q_2$, $q_3$ and $q_4$, are respectively in ranges of $-750$ nC$<q_1<-140$ nC, $-200$ nC$<q_2<-50$ nC, $+300$ nC$\leqq q_3 \leqq +625$ nC, and $-200$ nC $\leqq q_4 \leqq -50$ nC.

18. A developing apparatus according to claim 10, wherein $q_1$, $q_2$, $q_3$ and $q_4$ are respectively in ranges of $+50$ nC $<q_1+400$ nC, $+10$ nC $<q_2<+300$ nC, $-300$ nC$\leqq q_3 \leqq -50$ nC, and $+10$ nC $\leqq q_4 \leqq +300$ nC.

* * * * *